United States Patent [19]

Hucks

[11] Patent Number: 4,971,313

[45] Date of Patent: Nov. 20, 1990

[54] VENTRILOQUIST APPARATUS

[76] Inventor: Deborah A. Hucks, 1021 Highway 544, Coastal Village, #21, Conway, S.C. 29526

[21] Appl. No.: 514,673

[22] Filed: Apr. 25, 1990

[51] Int. Cl.[5] ..... A63J 5/00; A63J 19/00

[52] U.S. Cl. ..... 272/21; 272/9

[58] Field of Search ..... 446/82, 83, 84; 272/42, 272/46, 21, 11, 25, 9, 14; 358/185; 52/31, 29

[56] References Cited

U.S. PATENT DOCUMENTS

| | | | |
|---|---|---|---|
| 1,017,470 | 2/1912 | Rose | 52/31 |
| 1,880,147 | 9/1932 | Mullins | 52/31 |
| 2,283,104 | 5/1942 | Surman | 446/83 |
| 2,314,680 | 3/1943 | Batsel | 272/21 X |
| 2,351,293 | 6/1944 | Saunders | 272/46 |

*Primary Examiner*—Richard J. Johnson
*Attorney, Agent, or Firm*—Dority & Manning

[57] ABSTRACT

A ventriloquist apparatus includes one or two ventriloquist devices. Each ventriloquist device includes a rotatable platform divided by a backboard into a first half and a second half. The first half has a first quadrant and a second quadrant, and the second half has a third quadrant and a fourth quadrant. The order of the quadrants is arranged consecutively in a circular fashion. A first ventriloquist doll is detachably mounted on an inclined member which is connected by a vertex to a base member attached to the rotatable platform in the first quadrant thereof and inclined toward the perimeter of the rotatable platform. Similarly, a second ventriloquist doll is detachably mounted to an inclined member which is connected by a vertex to a base member attached to the rotatable platform in the third quadrant thereof and inclined toward the perimeter of the rotatable platform. The rotatable platform is rotatably connected by a rotatable bearing to a support platform having a diameter smaller than the diameter of the rotatable platform. A pedestal carries the support platform above the stage floor. A seat for supporting the ventriloquist is maintained at a predetermined distance from the pedestal by a spacer bar detachably connected to one end to the pedestal and at an intermediate portion to a cross-brace which supports the seat.

18 Claims, 2 Drawing Sheets

VENTRILOQUIST APPARATUS

BACKGROUND IF THE INVENTION

The present invention relates to ventriloquist apparatus. More particularly, the present invention relates to apparatus used in staging a ventriloquist performance.

In a typical ventriloquist act, the ventriloquist appears standing or seated onstage and holding one or two ventriloquist dolls. If the ventriloquist desires to substitute another doll for one which is onstage, typically the ventriloquist places the onstage doll into a trunk and takes the other doll from the trunk and brings it onstage. These movements into and out of the trunk are unnatural and disturb the continuity of the performance.

If the ventriloquist stands during the performance, the ventriloquist typically supports the doll on one arm while manipulating the doll with the hand on the other arm. Accordingly, the ventriloquist only can interact with one doll while the ventriloquist is in a standing position onstage. If the ventriloquist is seated onstage, it is possible to manipulate one doll with each hand. However, the ventriloquist must be careful to position each doll on the lap of the ventriloquist so that the audience, which typically has a perspective from beneath the stage, can see the doll's face. This requires the ventriloquist to keep each doll properly oriented toward the audience while simultaneously manipulating each doll with each hand. The same is true, if the seated ventriloquist rests the doll on a stage platform disposed in front of the seated ventriloquist.

OBJECTS AND SUMMARY OF THE INVENTION

It is a principal object of the present invention to provide apparatus to assist the ventriloquist during transfer of dolls from the onstage position, i.e., in the view of the ventriloquist's audience, to the offstage position, i.e., out of the view of the ventriloquist's audience, and the reverse transfer, namely, from offstage to onstage.

It is a further object of the present invention to provide an apparatus with which the ventriloquist can make doll transfers between onstage and offstage and vice versa with a single arm motion and without changing the audience's focus to an offstage location or a height other than the onstage location of the doll during the performance.

Another principal object of the present invention is to provide a ventriloquist apparatus having means for keeping the ventriloquist doll disposed relative to the audience so as to be viewed in plan from the perspective of the audience.

Yet another principal object of the present invention is to provide a ventriloquist apparatus that can be set up by stage hands with the proper spacings between various components of the apparatus reliably reproduced by the stage hands.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus is provided that simultaneously transfers at least a first ventriloquist doll from the onstage position to the offstage position while transferring at least a second ventriloquist doll from the offstage position to the onstage position. The ventriloquist apparatus of the present invention includes at least one ventriloquist device that comprises means for rotatably carrying at least two ventriloquist dolls. Preferably, the rotatably carrying means includes a rotatable platform having a first diameter and an upper surface defining four quadrants arranged consecutively in a circular fashion. The rotatably carrying means further preferable includes a disk-shaped support platform having a second diameter smaller than the first diameter of the rotatable platform. In addition, the rotatably carrying means includes a rotatable bearing disposed between and rotatably connecting the rotatable platform to the support platform.

In further accordance with the present invention, means are provided for separating the rotatably carrying means into a first half and a second half such that the first half includes first and second quadrants and the second half includes third and fourth quadrants, the quadrants being arranged consecutively in a circular order. One example of the means for separating the rotatably carrying means includes a backboard disposed diametrically, across the upper surface of the rotatably carrying means and extending in a direction normal to the rotatably carrying means to separate the upper surface of the rotatable platform into a first half and a second half. The backboard is sized and configured to keep one of the ventriloquist dolls offstage when the other of the ventriloquist dolls is onstage.

In yet further accordance with the present invention, means are provided for disposing a first one of the ventriloquist dolls in the first quadrant of the rotatably carrying means so as to be viewed in plan from a perspective originating from a location at a level lower than the level of the first ventriloquist doll. One example of the first doll disposing means includes a first base member, a first inclined member, and a first vertex. The first base member is attached to the rotatably carrying means in the first quadrant. The first inclined member is provided to receive a first one of the ventriloquist dolls. A first vertex joins the first base member to the first inclined member and defines an acute angle therebetween and points radially outwardly and toward the perimeter of the first quadrant. In this way, the first doll is positioned where it can be viewed in plan from a perspective originating from a location at a level lower than the level of the first ventriloquist doll when onstage.

Similarly, means also are provided for disposing a second one of the ventriloquist dolls in the third quadrant of the rotatable carrying means so as to be viewed in plan from a perspective originating from a location at a level lower than the level of the second ventriloquist doll when onstage. An example of the second doll disposing means includes a second base member attached to the third quadrant of the rotatably carrying means, a second inclined member that receives a second one of the ventriloquist dolls, and a second vertex joining the second base member and the second inclined member and defining an acute angle between the second base member and second inclined member. The second vertex points radially outwardly toward the perimeter of the third quadrant for positioning the second doll where it can be viewed in plan from a perspective originating from a location at a level lower than the level of the second ventriloquist doll when the second doll is disposed onstage.

In further accordance with the present invention, means are provided for removably securing the first ventriloquist doll to the first doll disposing means. An example of the removably securing means can include at least one bolt extending from the first inclined member and configured to be received by an opening disposed through the seat of the first ventriloquist doll. The bolt can have a threaded portion at least near the free end of the bolt. A nut also can be provided having a threaded opening for engaging the threaded portion of the bolt.

In further accordance with the present invention, means are provided for removably securing the second ventriloquist doll to the second doll disposing means. An example of the removably securing means can include at least one bolt extending from the second inclined member and configured to be received by an opening disposed through the seat of the second ventriloquist doll. The bolt can have a threaded portion at least near the free end of the bolt. A nut also can be provided having a threaded opening for engaging the threaded portion of the bolt.

In yet further accordance with the present invention, a pedestal can be provided that is disposed to carry the rotatably carrying means. In one example of the pedestal, at least three planar members are provided. Each planar member has a first edge disposed adjacent to the first edge of the other planar members, and each planar member radiates outwardly from the first edge. Each planar member has a second edge disposed normal to the first edge and supporting the rotatably carrying means.

In still further accordance with the present invention, a seat can be provided for supporting the ventriloquist. The seat preferably is disposed near enough to the rotatably carrying means to permit the ventriloquist to manipulate one of the dolls when the quadrant in which the doll is mounted is disposed adjacent the seat.

In yet further accordance with the present invention, a second ventriloquist device is provided for simultaneously transferring a third ventriloquist doll from the onstage position to the offstage position while at the same time transferring a fourth ventriloquist doll from the offstage position to the onstage position. This second ventriloquist device can be a duplicate of the first ventriloquist device described above. Accordingly, the second ventriloquist device includes means for rotatably carrying at least two ventriloquist dolls, means for separating the rotatably carrying means into a first half and a second half and four consecutively arranged quadrants wherein the separating means is sized and configured such that when one of the dolls is presented onstage the other doll is hidden offstage, and first and second doll disposing means, and a pedestal.

In still further accordance with the present invention, means are provided for controlling the relative spacing between the first ventriloquist device and the seat and between the second ventriloquist device and the seat. The relative spacing controlling means ensures that the seat is disposed near enough to the first ventriloquist device to permit the seated ventriloquist to manipulate one of the dolls mounted on the first ventriloquist device with one hand and near enough to the second ventriloquist device to permit the seated ventriloquist to manipulate one of the dolls mounted on the second ventriloquist device with the other hand. An example of the relative spacing controlling means includes a spacer bar having one end detachably secured to the pedestal of the first ventriloquist device and having an opposite end detachably secured to the pedestal of the second ventriloquist device. Each end of the elongated spacer bar preferably has a bracket depending in a direction transverse to the longitudinal axis of the spacer bar and defining a keyhole-shaped opening therethrough. A stud extending from the pedestal of a ventriloquist device is received in the keyhole opening of one end of the spacer bar, while a similar stud in the other ventriloquist device is received in the keyhole opening at the other end of the spacer bar. Thus, a constant predetermined distance is maintained between the two ventriloquist devices. The relative spacing controlling means further preferably includes means for detachably securing the seat at a first predetermined distance from the pedestal of the first ventriloquist device and at a second predetermined distance from the pedestal of the second ventriloquist device. Typically, the first predetermine distance will equal the second predetermined distance. In one embodiment, the spacer bar also further defines two pairs of intermediate brackets depending in a direction transverse to the longitudinal axis of the spacer bar. Each pair of intermediate brackets is disposed intermediate the opposite ends of the spacer bar and defines a slot therebetween. The seat preferably has four legs depending therefrom and at least two cross-braces extending transversely between at least two legs and supporting the seat. The two pairs of intermediate brackets are spaced so that one of the cross- braces is received in one of the slots and the other cross-brace is received in the other slot. Thus, the seat is maintained at a predetermined distance relative to each of the ventriloquist devices. With this predetermined distance, the ventriloquist seated on the seat can manipulate one of the dolls of the first ventriloquist device with one hand and one of the dolls of the second ventriloquist device with the other hand. In addition, the ventriloquist can selectively rotate the rotatable platform of the first ventriloquist device with movement of one arm to transfer one of the ventriloquist dolls mounted on the rotatable platform of the first ventriloquist device from the onstage position to the offstage position while at the same time transferring the other of the ventriloquist dolls of the first ventriloquist device from the offstage position to the onstage position. Moreover, the ventriloquist can selectively rotate the rotatable platform of the second ventriloquist device with movement of the other arm to transfer one of the ventriloquist dolls mounted on the rotatable platform of the second ventriloquist device from the onstage position to the offstage position while at the same time transferring the other of the ventriloquist dolls of the second ventriloquist device from the offstage position to the onstage position.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
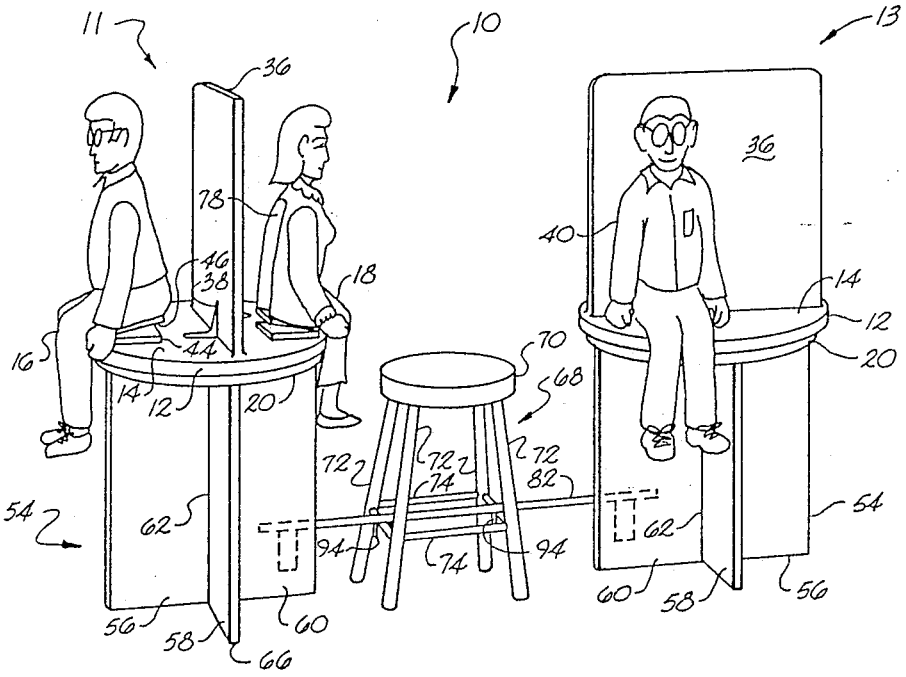
FIG. 1 illustrates a perspective view of a preferred embodiment of the ventriloquist apparatus of the present invention.
Figure 2:
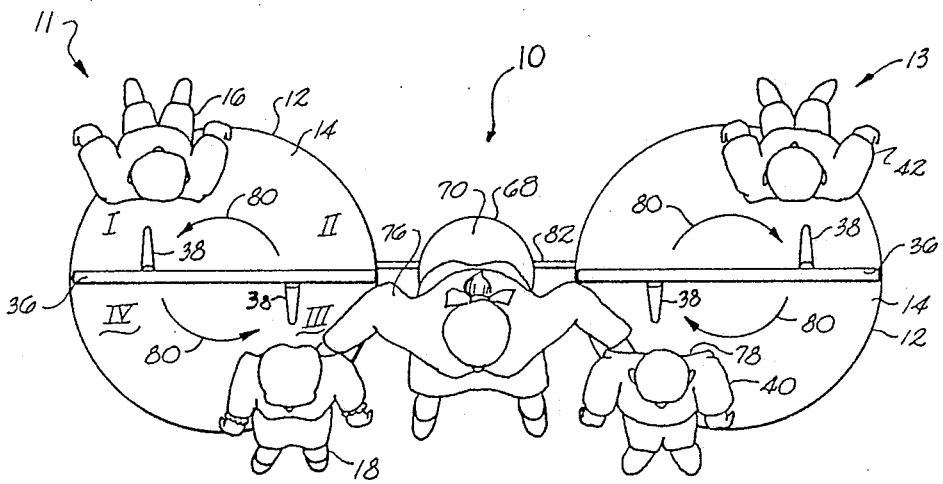
FIG. 2 illustrates a top plan perspective view of a ventriloquist seated in the operational position of a preferred embodiment of the ventriloquist apparatus of the present invention.

A preferred embodiment of the ventriloquist apparatus of the present invention is shown in each of FIGS. 1 and 2 and is represented generally by the numeral 10.

In accordance with the ventriloquist apparatus of the present invention, a first ventriloquist device is provided for simultaneously transferring a first ventriloquist doll from the onstage position, i.e., in the view of the ventriloquist's audience to the offstage position, i.e., out of the view of the ventriloquist's audience, and at the same time transferring a second ventriloquist doll from offstage to onstage with the aid of the movement of one of the ventriloquist's arms. In one preferred embodiment of the present invention, the apparatus provides a second ventriloquist device for simultaneously transferring a third ventriloquist doll from the onstage position to the offstage position while at the same time transferring a fourth ventriloquist doll from the offstage position to the onstage position with the aid of the movement of the ventriloquist's other arm. As shown in FIGS. 1 and 2 for example a first ventriloquist device is indicated generally by the designating numeral 11, and a second ventriloquist device is indicated generally by the designating numeral 13.

According to the first ventriloquist device of the present invention, means are provided for rotatably carrying at least two ventriloquist dolls. The means for rotatably carrying at least two ventriloquist dolls preferably includes a disk-shaped rotatable platform having a first diameter and an upper surface. The upper surface defines four quadrants arranged consecutively in a circular fashion such that each odd-numbered quadrant only shares a common boundary with each even-numbered quadrant. The rotatably carrying means further preferably includes a disk-shaped support platform having a second diameter smaller than the first diameter of the rotatable platform. Also included in the rotatably carrying means is a rotatable bearing disposed between and rotatably connecting the rotatable platform to the support platform. As embodied herein and shown in FIGS. 1–3 for example, a disk-shaped rotatable platform 12 can be formed of wood, metal, plastic, and preferably is fabricated from laminated fiber board. Rotatable platform 12 has a first diameter which can measure about 22 inches in one preferred embodiment. Rotatable platform 12 has an upper surface 14 that can be thought of as being divided into four quadrants arranged consecutively in a circular fashion, either clockwise or counterclockwise, such that each odd-numbered quadrant only would share a common boundary with each even-numbered quadrant. As an example, the quadrants of the rotatable platform shown to the left of FIG. 2 have been designated with Roman numerals. As shown in FIG. 2, the first quadrant I contains a first ventriloquist doll 16. Moving clockwise, quadrant II shares a common boundary (not delineated) with quadrant I. Quadrant III also contains a second ventriloquist doll 18 and shares a common boundary with each of quadrants II and IV. Still proceeding in a clockwise direction, quadrant IV shares a common boundary (not delineated) with quadrants III and I. As will become apparent to the reader, the ordering of the quadrants is adopted for the convenience of describing the relative locations of various aspects of the present invention.

Figure 3:
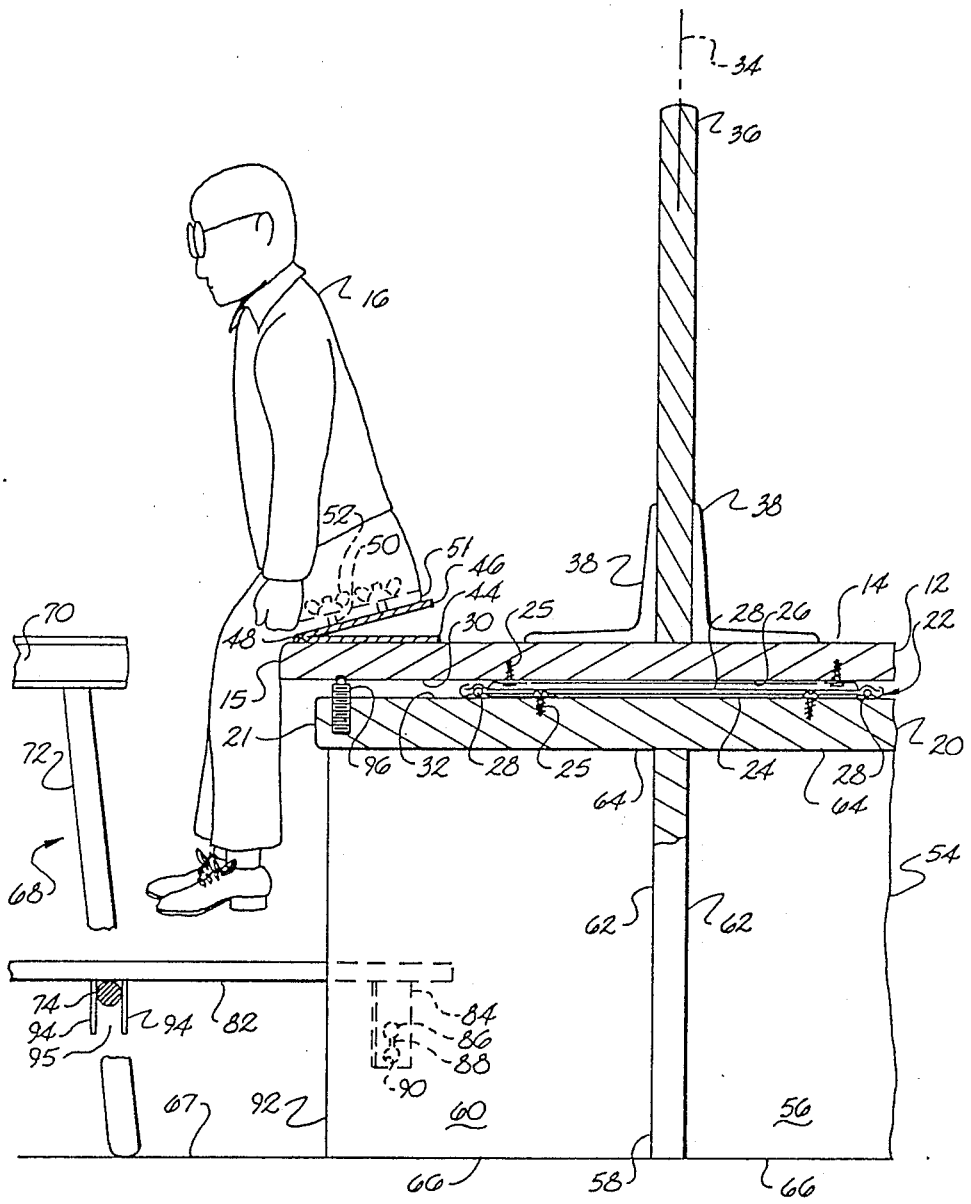
FIG. 3 illustrates a partial cut-away view of components of a preferred embodiment of the ventriloquist apparatus of the present invention.

As shown in FIGS. 1 and 3 for example, a disk-shaped support platform 20 is disposed beneath rotatable platform 12 and has a second diameter that is smaller than the first diameter of rotatable platform 12. In the embodiment in which rotatable platform 12 has a diameter of about 22 inches, support platform 20 has a diameter of about 20 inches. As best seen in the view shown in FIG. 3, note that while the legs of the ventriloquist doll rest against the side edge 15 of rotatable platform 12, the ventriloquist doll's legs do not rest against the side edge 21 of support platform 20. Thus, if rotatable platform 12 rotates relative to support platform 20, there is no frictional force between the legs of the ventriloquist doll and the edge 21 to support platform 20 that might result in a dragging motion of the legs of the ventriloquist doll as rotatable platform 12 rotated with respect to support platform 20. Such dragging motion is undesirable because it distracts the audience's attention away from the face of the doll and could result in the further audience distraction if the legs become entangled in the ventriloquist's costume.

As best illustrated in FIG. 3 for example, a rotatable bearing is designated generally by the numeral 22. 10 Rotatable bearing 22 is disposed between rotatable platform 12 and support platform 20. Preferably, the same type of bearing 22 that one normally finds in a lazy susan apparatus is used as the rotatable bearing 22 for the present invention. Rotatable bearing 22 preferably includes a lower race 24 and an upper race 26, which are carried and separated by a multitude of ball bearings 28 arranged in toroidal tracks between the two races 24, 26. The two bearing races 24, 26 preferably are secured by screws 25 to their respective surfaces of rotatable platform 12 and support platform 20. Lower race 24 of bearing 22 is secured by screws 25 to the upper surface 32 of support platform 20. Upper race 26 of bearing 22 is secured by screws 25 to the lower surface 30 of rotatable platform 12. Rotatable platform 12, support platform 20, and rotatable bearing 22 are all arranged relative to one another in a concentric fashion about a central axis indicated by a dashed line 34 in FIG. 3. In the embodiment of the present invention having a 22 inch diameter for the rotatable platform, the outside diameter of bearing 22 should be about 12 inches, and the thickness of the bearing 28 should be about one quarter inch to about ⅜ inch. A suitable lazy susan type bearing 22 is available from the Triangle Manufacturing Company of Oshkosh, Wis.

In further accordance with the first ventriloquist device of the present invention, means are provided for separating the rotatably carrying means into a first half and a second half. The first half includes a first quadrant and a second quadrant. The second half includes a third quadrant and a fourth quadrant. The quadrants are arranged consecutively in a circular order. The means for separating the rotatably carrying means into first and second halves preferably includes a backboard that is disposed diametrically across the upper surface of the rotatably carrying means and extends in a direction normal to the rotatably carrying means. The backboard preferably is sized and configured to keep one of the ventriloquist dolls offstage when the other of the ventriloquist dolls is onstage. As embodied herein and shown in FIGS. 1–3 for example, the separating means preferably includes a backboard 36 disposed diametrically across upper surface 14 of rotatable platform 12. Backboard 36 preferably is planar and can be formed of the same materials as rotatable platform 12 and/or support platform 20. Backboard 36 preferably is mounted with a bottom edge of upper surface 14 of rotatable platform 12 and extends in a direction that is normal to upper surface 14 of platform 12. A pair of right-angle brackets 38 can have one leg secured, as by screws, to rotatable platform 12 and one leg secured to backboard 36 to maintain backboard 36 in a normal orientation relative to rotatable platform 12. As shown in FIGS. 1–3 for example, backboard 36 is sized and configured to keep one of the dolls offstage when the other doll is onstage. This aspect of backboard 36 is best illustrated in second ventriloquist device 13 in the upper right hand corner of FIG. 1. A third ventriloquist doll 40 is shown in the onstage position, and a fourth ventriloquist doll 42 (shown in FIG. 2 for example,) is hidden from the audience's view and kept offstage. As shown in the left hand portion of FIG. 2 for example, backboard 36 extends diametrically across upper surface 14 of rotatable platform 12 and divides same into a first half including first quadrant I and second quadrant II and a second half including third quadrant III and fourth quadrant IV.

In still further accordance with the first ventriloquist device of the present invention, means are provided for disposing a first one of the ventriloquist dolls in the first quadrant of the rotatably carrying means so that the audience may view the doll, especially the doll's face, in plan from a perspective originating from a location at a level lower than the level of the first ventriloquist doll. Typically, the ventriloquist performs on a stage that is elevated from the line of sight of the audience. Accordingly, the ventriloquist doll must be tilted toward the audience so that the face of the doll can be seen in a plan view by the audience. The first doll disposing means preferably includes a first base member attached to the rotatably carrying means in the first quadrant thereof. The disposing means for the first doll further includes a first inclined member for receiving the first ventriloquist doll. The disposing means for the first doll further preferably includes a first vertex that joins the first base member and the first inclined member. The first vertex preferably defines an acute angle between the first base member and the first inclined member and points toward the perimeter of the first quadrant so that the first doll becomes positioned where it can be seen in a plan view from the audience's perspective, even though the line of the sight of the audience originates from a location at a level lower than the level of the first ventriloquist doll. The first base member, the first inclined member, and the first vertex combine to form a first wedge-shape support that has two surfaces joined at the vertex and defining an acute angle therebetween.

As embodied herein and shown in FIGS. 1 and 3 for example, a first base member 44 is attached to upper surface 14 of rotatable platform 12 in the first quadrant I. A first inclined member 46 is inclined at an angle above first base member 44 and is disposed for receiving the first ventriloquist doll 16. A first vertex 48 (FIG. 3) defines an acute angle between first base member 44 and first inclined member 46 and points radially outwardly towards the perimeter (toward edge 15 of rotatable platform 12) of first quadrant I. The seat (buttocks) of the first ventriloquist doll is received on the upper surface of first inclined member 46 and accordingly tilts the doll, including the face of the doll, in a forward inclining position so that the plane of the doll's face is normal to a line of sight that originates from a location at a level lower than the level of the face of the ventriloquist doll. This is the line of sight likely to be taken by members of the audience looking up at the stage on which the ventriloquist apparatus resides. Because the audience is at some distance from the stage, and thus a similar distance from the ventriloquist apparatus, the angle of inclination defined by vertex 48 can be less than 30° and preferably will be about 10°. for most audience-to-stage distances. The farther away the audience resides from where the ventriloquist device has been located, the smaller the angle between first base member 44 and first inclined member 46 needs to be.

As shown in FIG. 3 for example, means are provided for removably securing the first ventriloquist doll to the doll disposing means. As embodied herein, the means for removably securing the ventriloquist doll to the doll disposing means preferably includes any mechanism that can be used to fasten the doll to the inclined member so long as the fastening mechanism can be unfastened, preferably by hand unaided by tools, to remove the doll from the inclined member. As shown in FIG. 3 for example, at least one bolt 50 is mounted to extend in a normal direction from the surface of first inclined member 46. Though not visible in FIG. 3, at least the end of bolt 50 has been threaded to receive a threaded nut therearound. In this embodiment, an opening is disposed through the seat 51 of the first ventriloquist doll 16, and this opening is configured to receive bolt 50 therethrough. A nut such is a wing nut 52 has a threaded opening that matingly engages the threaded portion of bolt 50. Preferably, at least a pair of bolts 50, nuts 52, and openings in the seat of the doll are provided so that when the openings in the seat of the doll receive the bolts therethrough and the nuts are screwed onto the bolts, the doll is held securely against the upper surface of first inclined member 46 and will not move relative to same when the rotatable platform is rotated or the ventriloquist is operating the doll.

As shown in FIG. 1 for example, means also are provided for disposing a second one of the ventriloquist dolls in the third quadrant of the rotatably carrying means. This second doll disposing means is identical in construction to the first doll disposing means, except that the base member for this second doll disposing means is attached to the rotatably carrying means in the third quadrant. Thus, the second doll disposing means similarly has second base member attached to the rotatably carrying means in the third quadrant, a second inclined member for receiving the second ventriloquist doll, a second vertex joining each of the second base member and the second inclined member, and means for removably securing the second ventriloquist doll to the second doll disposing means. The means for removably securing the second doll from the second doll disposing means also can include a bolt and nut arrangement or any mechanism which permits the doll to be removably secured to the doll disposing means.

The first ventriloquist device of the present invention also preferably includes a pedestal that carries the rotatably carrying means and raises it above the floor of the stage on which the ventriloquist apparatus is set up. As embodied herein and shown in FIGS. 1 and 3 for example, a pedestal is indicated generally by the designating numeral 54. Pedestal 54 defines at least three planar members, and the embodiment shown in FIGS. 1 and 3 includes four planar members, though one of the four members is obscured from view. The three planar members visible in FIGS. 1 and 3 are numbered 56, 58, and 60. Each planar member has a first edge 62 that is disposed adjacent the first edge 62 of the other planar members. The relative location of the first edges is indicated in FIG. 1 by the designating numeral 62. Each planar member 56, 58 and 60, radiates outwardly from first edges 62. Each planar member has a second edge disposed normal to first edge 62 and supporting the rotatably carrying means. The second edges are indicated in FIG. 3 by the designating numeral 64. Second edges 64 are disposed against the lower surface of support platform 20 and attached to same to carry same. Though not shown in the Figs., a plurality of non-rolling castors can be disposed against the bottom edges 66 of each planar member of pedestal 54 to carry pedestal 54 above the floor 67 (FIG. 3) on which it rests.

In yet further accordance with the ventriloquist apparatus of the present invention, a seat is provided for supporting the ventriloquist. The seat should be disposed near enough to the rotatably carrying means so that the ventriloquist can manipulate one of the dolls while seated on the seat. As embodied herein and shown in FIGS. 1 and 3 for example, a stool indicated generally by the numeral 68 has a seat 70, four legs 72, and four crosspieces 74 connecting the lower portions of legs 72. As shown in FIG. 2 for example, the height of stool 68 should permit the ventriloquist 76 to be able to manipulate the ventriloquist doll comfortably with one hand grasping the controls located in an opening 78 (doll 18 in FIG. 1 and 40 in FIG. 2 for example) at the back of the ventriloquist doll. These controls can be standard in the manufacture of ventriloquist dolls, and thus are not shown. However, the second ventriloquist doll 18 shown in FIG. 1 is positioned so that opening 78 in the back of the doll 16 can be partially seen.

In still further accordance with the present invention, the ventriloquist apparatus can include a second ventriloquist device which includes a second rotatably carrying means, means for disposing a third ventriloquist doll in the first quadrant of the second rotatably carrying means, means for disposing a fourth ventriloquist doll in the third quadrant of the second rotatably carrying means, and a second means for separating the second rotatably carrying means into two halves with four quadrants arranged consecutively in a circular order. As the particulars of these features of the second ventriloquist device are the same as the features of the first ventriloquist device already described above, they are not repeated here. Suffice it to say that this second ventriloquist device simultaneously transfers a third ventriloquist doll from the onstage position to the offstage position while at the same time enabling the ventriloquist to transfer a fourth ventriloquist doll from offstage to onstage.

The transfer movement which can be performed by each ventriloquist device is best envisioned by reference to FIG. 2. Ventriloquist 76 moves the elbow of the arm used to allow the hand to reach into an opening 78 in the back of the ventriloquist doll. This elbow is pushed against backboard 36 so that the ventriloquist doll being manipulated moves toward the ventriloquist as shown by arrows 80 in FIG. 2. Arrows 80 indicate the direction of movement of rotatable platform 12 and backboard 36 secured thereto as the onstage doll is transferred offstage and the offstage doll is transferred onstage. As rotatable platform 12 rotates the offstage doll into position where the ventriloquist can reach into opening 78, this hand movement reaching into opening 78 also stops the doll from rotating and accordingly stops rotation of rotatable platform 12 secured to the doll via the base member 44 and the inclined member 46. The rotatable bearing ensures smooth rotation of rotatable platform 12 relative to support platform 20. The transfer occurs quickly and without diverting the attention of the audience to a line of sight that differs from the line of sight occupied by the doll which begins onstage as the transfer takes place. Moreover, the natural movement of the ventriloquist's arm as the ventriloquist pulls his or her hand out from behind opening 78 in the back of the ventriloquist doll is the same direction of movement needed to push against backboard 36 with the elbow of this ventriloquist arm to set the rotatable platform into its rotating motion needed to effect the transfer of the dolls from offstage to onstage and onstage to offstage. Furthermore, the movement of the hand of the ventriloquist into the opening of the doll that is moving to the onstage position is the same direction of movement needed to stop rotation of the rotatable platform. The correspondence in the directions of these movements permits economy of movement to be obtained when making the transfer movements. This increases the speed with which the transfer can be made and also minimizes the number of movements and distraction of the audience during the transfer.

In yet further accordance with the present invention, means are provided for controlling the relative spacing between the first ventriloquist device and the seat, and in appropriate embodiments, between the second ventriloquist device and the seat. The spacing control means ensures that the seat is disposed near enough to each ventriloquist device to permit a seated ventriloquist to manipulate one of the dolls mounted on each apparatus comfortably with one hand and to make the transfer of the onstage and offstage dolls when desired. As shown for example in FIGS. 1–3, the relative spacing control means preferably includes a spacer bar 82. One end of the spacer bar is detachably secured to the pedestal of one of the ventriloquist devices, and the other end of the spacer bar is detachably secured to the pedestal of the other ventriloquist device. The means provided for detachably securing each end of the spacer bar to one of the pedestals of one of the ventriloquist devices preferably includes an end attachment plate 84 and a stud 86. As showing phantom (dashed line) in FIG. 3 for example, an end attachment plate 84 defines a keyhole shaped opening with an elongated slot having a smaller width portion 88 closer to bar 82 and a larger width portion 90 disposed farther from bar 82. A stud 86 is disposed to extend in a normal direction from the planar surface of a planar member 60 of a pedestal 54.

Preferably, each stud 86 is disposed near a side edge 92 of a planar member such as planar member 60 of pedestal 54. Each stud 86 has a free end configured to pass through larger width portion 90 of the keyhole opening of plate 84, but not through smaller width portion 88 of the keyhole opening. Each stud 86 further defines a stem (not visible in the Figs.) connecting the free end of stud 86 to bar 82, and the stem is configured to pass through smaller width portion 88 of the keyhole opening of plate 84. A similar plate 84 is formed on the opposite end of bar 82, and a similar stud 86 is formed on the other ventriloquist device. To secure an end of the spacer bar to the pedestal, the larger width portion of the keyhole opening in the attachment plate is passed over the free end of the stud to the stem, and then bar 82 is positioned to fit the stem into the smaller width portion of the keyhole opening of the plate. To detach the bar from the pedestal, the reverse motions are performed.

The relative spacing control means further preferably includes means for detachably securing the seat at a first predetermined distance from the pedestal of the first ventriloquist device and at a second predetermined distance from the pedestal of the second ventriloquist device. As embodied herein and shown in FIG. 3 for example, the means for detachably securing the seat at a predetermined distance from the pedestals of a ventriloquist device preferably includes a pair of intermediate depending bracketing members 94. Each bracketing member 94 depends from spacer bar 82 in a direction transverse to the longitudinal axis thereof and cooperates with the adjacent bracketing member in the pair to form a slot 95 therebetween. Each slot 95 is just wide enough to receive a cross-brace 74 transversely therein. As shown in FIG. 1 for example, one pair of intermediate bracketing members 94 straddles one of the cross-braces 74 of stool 68, and the other set of depending bracketing members 94 straddles a cross-brace 74 dispersed opposite to the first cross-brace straddled by the first set of depending bracketing members 94. In this way, neither the cross-braces 74 nor the seat 70 of stool 68 can move toward or away from either pedestal 54 of either ventriloquist device. Accordingly, the distance between the seat and the respective pedestal of each ventriloquist device is maintained constant. Moreover, spacer bar 82 can be raised to disengage both sets of depending bracketing members 94 from cross braces 74 of stool 68. Seat 70 of stool 68 preferably is maintained at a distance of about 6 inches from edge 15 of rotatable platform 12 when measured in a common plane. This 6 inch distance permits the legs of the dolls to pass by the seated ventriloquist.

The weight of the dolls, the rotatable platform, and the backboard is not so great that a large amount of effort is needed to start or stop their rotational movement. However, if desired, one can use a spring-loaded detent disposed in one of the rotatable platforms or the support platform with a pair of recesses oriented 180° apart. The recesses can be oriented so that when the detent slips into the recess, the rotatable platform is oriented at a position where it should come to rest. A spring-loaded detent mechanism 96 is shown in FIG. 3 for example.

What is claimed is:

1. A ventriloquist apparatus for simultaneously transferring a first ventriloquist doll from the onstage position, i.e., in the view of the ventriloquist's audience, to the offstage position, i.e., out of the view of the ventriloquist's audience, and at the same time transferring a second ventriloquist doll from offstage to onstage, the apparatus comprising:

(a) means for rotatably carrying at least two ventriloquist dolls;

(b) means for separating said rotatably carrying means into a first half and a second half, said first half including first and second quadrants and said second half including third and fourth quadrants, said quadrants being arranged consecutively in a circular order;

(c) means for disposing a first one of the ventriloquist dolls in said first quadrant of said rotatably carrying means so as to be viewed in plan from a perspective originating from a location at a level lower than the level of said first ventriloquist doll;

(d) means for disposing a second one of the ventriloquist dolls in said third quadrant of said rotatably carrying means so as to be viewed in plan from a perspective originating from a location at a level lower than the level of the second ventriloquist doll; and (e) wherein said separating means being sized and configured such that when one of the dolls is presented onstage the other of the dolls is hidden offstage.

2. An apparatus as in claim 1, wherein:

said means for rotatably carrying at least two ventriloquist dolls includes:

(i) a disk-shaped rotatable platform having a first diameter and an upper surface defining four quadrants arranged consecutively in a circular fashion such that each odd-numbered quadrant only shares a common boundary with each even-numbered quadrant;

(ii) a disk-shaped support platform having a second diameter smaller than said first diameter of said rotatable platform; and (iii) a rotatable bearing disposed between and rotatably connecting said rotatable platform to said support platform.

3. An apparatus as in claim 1, wherein:

said means for separating said rotatably carrying means into a first half and a second half includes a backboard disposed diametrically across the upper surface of said rotatably carrying means and extending in a direction normal to said rotatably carrying means to separate said upper surface of said rotatable platform into a first half and a second half, said first half including said first and second quadrants and said second half including said third and fourth quadrants, said backboard being sized and configured to keep one of said dolls offstage when the other of said dolls is onstage.

4. An apparatus as in claim 1, wherein: said means for disposing a first one of the ventriloquist dolls in said first quadrant of said rotatably carrying means so as to be viewed in plan from a perspective originating from a location at a level lower than the level of said first ventriloquist doll includes:

(i) a first base member attached to the rotatably carrying means in said first quadrant, (ii) a first inclined member for receiving a first one of the ventriloquist dolls, (iii) a first vertex joining each of said first base member and said first inclined member, said first vertex defining an acute angle between said first base member and said first inclined member and pointing toward the perimeter of said first quadrant for positioning said first doll where it can be viewed in plan from a perspective originating from a location at a level lower than the level of said first ventriloquist doll.

5. An apparatus as in claim 4, further comprising:

(f) means for removably securing said first ventriloquist doll to said disposing means 6. An apparatus as in claim 5, wherein: said means for removably securing a first one of said ventriloquist dolls to said disposing means includes:

(i) at least one bolt extending from said first inclined member and configured to be received by an opening disposed through the seat of said first ventriloquist doll, said bolt having a threaded portion at least near the free end thereof, and (ii) a nut having a threaded opening for engaging said threaded portion of said bolt.

7. An apparatus as in claim 1, wherein:

said means for disposing a second one of the ventriloquist dolls in said third quadrant of said rotatably carrying means so as to be viewed in plan from a perspective originating from a location at a level lower than the level of said second ventriloquist doll includes:

(i) a second base member attache to the rotatably carrying means in said third quadrant, (ii) a second inclined member for receiving a second one of the ventriloquist dolls, (iii) a second vertex joining each of said second base member and said second inclined member, said second vertex defining an acute angle between said second base member and said second inclined member and pointing toward the perimeter of said third quadrant for positioning said second doll where it can be viewed in plan from a perspective originating from a location at a level lower than the level of said second ventriloquist doll.

8. An apparatus as in claim 7, further comprising:

(f) means for removably securing said second ventriloquist doll to said second doll disposing means.

9. An apparatus as in claim 8, wherein:

said means for removably securing a second one of said ventriloquist dolls to said second doll disposing means includes:

(i) at least one bolt extending from said second inclined member and configured to be received by an opening disposed through the seat of said second ventriloquist doll, said bolt having a threaded portion at least near the free end thereof, and (ii) a nut having a threaded opening for engaging said threaded portion of said bolt.

10. An apparatus as in claim 9, further comprising:

(g) a pedestal disposed to carry said rotatably carrying means.

11. An apparatus as in claim 10, wherein:

said pedestal defines at least three planar members, each planar member has a first edge disposed adjacent said first edge of said other planar members, each said planar member radiates outwardly from said first edge, each planar member having a second edge disposed normal to said first edge and supporting said rotatably carrying means.

12. An apparatus as in claim 10, further comprising:

(h) a seat for supporting the ventriloquist, said seat being disposed near enough to said rotatably carrying means to permit a seated ventriloquist to manipulate one of said dolls.

13. An apparatus as in claim 12, further comprising:

(i) a second ventriloquist device for simultaneously transferring a third ventriloquist doll from the onstage position to the offstage position while at the same time transferring a fourth ventriloquist doll from offstage to onstage.

14. An apparatus as in claim 13, further comprising:

(j) means for controlling the relative spacing between said first ventriloquist device and said seat and between said seat and said second ventriloquist device so that said seat is disposed near enough to said first ventriloquist device to permit the seated ventriloquist to manipulate one of said dolls mounted on said first ventriloquist device with one hand and near enough to said second ventriloquist device to permit the seated ventriloquist to manipulate one of said dolls mounted on said second ventriloquist device with the other hand.

15. An apparatus as in claim 14, wherein:

said relative spacing controlling means includes a spacer bar having one end detachably secured to said pedestal of said first ventriloquist device and having an opposite end detachably secured to said pedestal of said second ventriloquist device, said relative spacing controlling means further including means for detachably securing said seat at a first predetermined distance from said pedestal of said first ventriloquist device and at a second predetermined distance from said pedestal of said second ventriloquist device.

16. An apparatus as in claim 14, wherein: said relative spacing controlling means includes:

(i) an elongated spacer bar having opposite ends, each end of said spacer bar having an attachment plate depending in a direction transverse to the longitudinal axis of said spacer bar and defining a keyhole shaped opening therethrough, (ii) a pair of studs, one of said studs extending from said pedestal of said first ventriloquist device and the other of said studs extending from said pedestal of said second ventriloquist device, wherein one of said studs is detachably received in said keyhole opening of one of said end brackets and the other of said studs is detachably received in said keyhole opening of the other of said and brackets, (iii) two pairs of intermediate brackets depending in a direction transverse to the longitudinal axis of said spacer bar, each pair of intermediate brackets being disposed intermediate said opposite ends of said spacer bar, each pair of intermediate brackets defining a slot therebetween, and (iv) a pair of cross-braces for supporting said seat, wherein one of said cross-braces is detachably received in said slot of one of said pairs of intermediate brackets and the other of said cross-braces is detachably received in said slot of the other of said pairs of intermediate brackets.

17. An apparatus as in claim 13, further comprising:

(j) a spacer bar, said spacer bar being configured to maintain sufficient separation between said first ventriloquist device and said second ventriloquist device to permit said ventriloquist seated on said seat to manipulate one of said dolls of said first ventriloquist device with one hand and one of said dolls of said second ventriloquist device with the other hand and to permit said ventriloquist seated on said seat to selectively rotate said rotatable platform of said first ventriloquist device with movement of one arm to transfer one of said ventriloquist dolls mounted on said rotatable platform of said first ventriloquist device from the onstage position to the offstage position while at the same time transferring the other of said ventriloquist dolls of said first ventriloquist device from the offstage position to the onstage position and to selectively rotate said rotatable platform of said second ventriloquist device with movement of the other arm to transfer one of said ventriloquist dolls mounted on said rotatable platform of said second ventriloquist device from the onstage position to the offstage position while at the same time transferring the other of said ventriloquist dolls of said second ventriloquist device from the offstage position to the onstage position.

18. A ventriloquist apparatus, comprising:

(a) a first ventriloquist device for simultaneously transferring a first ventriloquist doll from the onstage position, i.e., in the view of the ventriloquist's audience, to the offstage position, i.e., out of the view of the ventriloquist's audience, and at the same time transferring a second ventriloquist doll from offstage to onstage, the device including:

(i) a circular disk-shaped rotatable platform having a first diameter and an upper surface defining four equal area and symmetrically-shaped quadrants 12 arranged consecutively in a circular fashion such that each odd-numbered quadrant only shares a common boundary with each even-numbered quadrant;

(ii) a first wedge-shaped support having two surfaces joined at a vertex and defining an acute angle therebetween, one of said surfaces of said wedge-shaped support having at least one bolt extending therefrom and configured to be received by an opening disposed through the seat of said first ventriloquist doll, said other surface of said wedge-shaped support being disposed in said first quadrant of said upper surface of said rotatable platform with said vertex pointing toward the perimeter of said first quadrant for positioning said first doll where it can be operated by the ventriloquist when the ventriloquist is seated adjacent said first quadrant of said rotatable platform;

(iii) a second wedge-shaped support having two surfaces joined at a vertex and defining an acute angle therebetween'one of said surfaces of said second wedge-shaped support having at least one bolt extending therefrom and configured to be received by an opening disposed through the seat of said second ventriloquist doll, said other surface of said second wedge-shaped support being disposed in said third quadrant of said upper surface of said rotatable platform with said vertex pointing toward the perimeter of said third quadrant for positioning said second doll where it can be operated by the ventriloquist when the ventriloquist is seated adjacent said third quadrant of said rotatable platform;

(iv) a backboard disposed diametrically across the upper surface of said rotatable platform and extending in a direction normal to said rotatable platform to separate said upper surface of said rotatable platform into a first half and a second half, said first half including said first and second quadrants and said second half including said third and fourth quadrants, said backboard being sized and configured to keep one of said dolls offstage when the other of said dolls is onstage;

(v) a disk-shaped support platform having a second diameter smaller than said first diameter of said rotatable platform; and (vi) a rotatable bearing disposed between and rotatably connecting said rotatable platform to said support platform;

(vii) a pedestal disposed to carry said support platform, said pedestal defining at least three planar members, each planar member having a first edge disposed adjacent said first edge of said other planar members, each said planar member radiating outwardly from said first edge, each planar member having a second edge disposed normal to said first edge and supporting said support platform; (b) a seat for supporting the ventriloquist; (c) a second ventriloquist device for simultaneously transferring a third ventriloquist doll from the onstage position to the offstage position while at the same time transferring a fourth ventriloquist doll from offstage to onstage; (d) a spacer bar having one end connected to said first ventriloquist device and having an opposite end connected to said second ventriloquist device; and (e) wherein said spacer bar being configured to maintain sufficient separation between said first ventriloquist device and said seat and said second ventriloquist device and said seat to permit the ventriloquist seated on said seat to manipulate one of said dolls of said first ventriloquist device with one hand and one of said dolls of said second ventriloquist device with the other hand and to permit said ventriloquist seated on said seat to selectively rotate said rotatable platform of said first ventriloquist device with movement of one arm to transfer one of said ventriloquist dolls mounted on said rotatable platform of said first ventriloquist device from the onstage position to the offstage position while at the same time transferring the other of said ventriloquist dolls of said first ventriloquist device from the offstage position to the onstage position and to selectively rotate said rotatable platform of said second ventriloquist device with movement of the other arm to transfer one of said ventriloquist dolls mounted on said rotatable platform of said second ventriloquist device from the onstage position to the offstage position while at the same time transferring the other of said ventriloquist dolls of said second ventriloquist device from the offstage position to the onstage position.

* * * * *